US011324349B2

(12) United States Patent
Grant et al.

(10) Patent No.: US 11,324,349 B2
(45) Date of Patent: May 10, 2022

(54) EXTENDABLE MAILBOX

(71) Applicants: Catherine Grant, Newburyport, MA (US); Jason McGrath, Broomfield, CO (US)

(72) Inventors: Catherine Grant, Newburyport, MA (US); Jason McGrath, Broomfield, CO (US)

(73) Assignee: Catherine Grant, Newburyport, MA (US)

( * ) Notice: Subject to any disclaimer, the term of this patent is extended or adjusted under 35 U.S.C. 154(b) by 187 days.

(21) Appl. No.: 16/833,609

(22) Filed: Mar. 29, 2020

(65) Prior Publication Data

US 2021/0298506 A1 Sep. 30, 2021

(51) Int. Cl.
*A47G 29/12* (2006.01)

(52) U.S. Cl.
CPC ..... *A47G 29/1216* (2013.01); *A47G 29/1209* (2013.01)

(58) Field of Classification Search
CPC . A47G 29/1216; A47G 29/1209; F16M 11/08
USPC ..... 232/38, 29; 248/131, 145, 417
See application file for complete search history.

(56) References Cited

U.S. PATENT DOCUMENTS 1,731,682 A * 10/1929 Pendergrass ..... A47G 29/1216 248/128
1,992,640 A 2/1935 Steen
2,279,622 A * 4/1942 Frankp ..... A47G 29/1216 248/145
2,605,073 A * 7/1952 Buck ..... A47G 29/1216 248/145
2,723,098 A * 11/1955 Moore ..... A47G 29/1216 248/128
2,781,964 A 2/1957 Ledgerwood
2,936,143 A * 5/1960 Harry ..... A47G 29/1216 248/145
3,289,988 A * 12/1966 McKenney ..... A47G 29/1216 248/145
3,465,994 A * 9/1969 Block ..... A47G 29/1216 248/130
3,497,078 A * 2/1970 Vern ..... A47G 29/1216 211/79
3,870,262 A * 3/1975 Manning, Jr. ..... A47G 29/1216 248/145
3,999,702 A * 12/1976 Conroy ..... A47G 29/1216 232/39
4,113,213 A * 9/1978 Gay ..... A47G 29/1216 16/275

(Continued)

*Primary Examiner* — William L Miller
(74) *Attorney, Agent, or Firm* — Tatonetti IP

(57) ABSTRACT

An extendable and resilient mailbox is implemented in which the mailbox can revertibly extend outward to improve accessibility to the mailbox during heavy snowfall. The extendable mailbox is also configured with break-away action which enables the mailbox to laterally move and resiliently revert (or "break away") to a base position. For example, when a snow plow inadvertently crashes into the extended mailbox, the mailbox will laterally move in the direction of the encounter to reduce the chances of or prevent the mailbox's destruction. Once the snow plow has passed or at least is no longer clashing with the mailbox, the extendable mailbox reverts back to its base position in which it is aligned with the mailbox post.

13 Claims, 8 Drawing Sheets

(56) References Cited

U.S. PATENT DOCUMENTS 4,480,403 A * 11/1984 Williams ..... A01G 17/14 47/42
4,484,705 A * 11/1984 Sande ..... A47G 29/1216 232/39
4,496,123 A 1/1985 Laramie
4,852,847 A * 8/1989 Pagel ..... A47G 29/1216 248/548
4,995,576 A 2/1991 Kieswetter
5,215,283 A * 6/1993 Gould ..... A47G 29/1216 232/39
5,425,501 A 6/1995 Wesorick
D371,884 S * 7/1996 Esgro ..... D99/29
5,941,455 A * 8/1999 Cutugno ..... A47G 29/1216 232/39
6,161,756 A * 12/2000 Upton ..... A47G 29/1216 232/39
6,164,527 A * 12/2000 Garey ..... A47G 29/1216 232/39
6,543,680 B1 4/2003 McCormack
6,988,655 B1 1/2006 Riccio
6,997,373 B2 2/2006 Flores
7,004,380 B2 2/2006 Gunvaldson
7,163,142 B2 * 1/2007 DeLine ..... A47G 29/1216 232/39
7,210,616 B1 5/2007 Van Watermulen
7,353,985 B1 * 4/2008 Weatherholt, II .. A47G 29/1216 232/39
7,389,911 B2 * 6/2008 Ruocco ..... A47G 29/1216 232/39
7,481,357 B1 * 1/2009 Totis ..... A47G 29/1216 232/39
8,875,987 B2 11/2014 Supulski et al.
2002/0139904 A1 * 10/2002 Lowell ..... A47G 29/1216 248/145
2006/0255117 A1 * 11/2006 DeLine ..... A47G 29/1216 232/39
2007/0235515 A1 10/2007 Ruocco
2008/0035719 A1 2/2008 Lyristakis
2010/0282832 A1 * 11/2010 Do ..... A47G 29/1216 232/39

* cited by examiner

EXTENDABLE MAILBOX

BACKGROUND

Areas that are prone to heavy snowfall can experience difficulties in receiving mail due to inaccessibility to the mailbox created by the snow. Since it is typically the homeowner's responsibility, failure to make a clear path to the mailbox for the mail carrier can result in non-delivery of mail. Making matters worse, snow plows hired to clear the streets can crash into and destroy an owner's mailbox. Areas which are prone to heavy snowfall can deal with these issues on a semi-regular basis during the winter season.

SUMMARY

An extendable and resilient mailbox is implemented in which the mailbox can revertibly extend outward on a telescoping rod to improve accessibility to the mailbox during heavy snowfall. The extendable mailbox is also configured with break-away action which enables the mailbox to laterally move and resiliently revert (or "break away") to a base position. For example, when a snow plow inadvertently crashes into the extended mailbox, the mailbox will laterally move in the direction of the encounter to reduce the chances of or prevent the mailbox's destruction. Once the snow plow has passed or at least is no longer clashing with the mailbox, the extendable mailbox reverts back to its base position.

In typical implementations, the extendable mailbox may include a set of telescoping rods to which a mail receptacle is secured to enable the receptacle to move outward and inward relative a post. The post may be a wooden 4×4 which is secured to a base, such as the ground. The post includes a bracket to which an enclosure element is secured, and the telescoping rods may be connected to the enclosure element. Inside the enclosure element is spring which enables break-away action when the receptacle is extended. That is, the receptacle and telescoping rods can laterally pivot when some outside force inadvertently crashes into them, and then revert back to their original position once the outside force disappears.

The end telescoping rod which is furthest from the post includes a handle to enable a person to pull and thereby extend the telescoping rods and receptacle. Furthermore, a retractable rod can also be implemented which enables a user to retract the telescoping rods and receptacle back to their un-extended base position. The retractable rod may be a rigid rod which can also be used to extend the mailbox when the user cannot access the handle in front.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
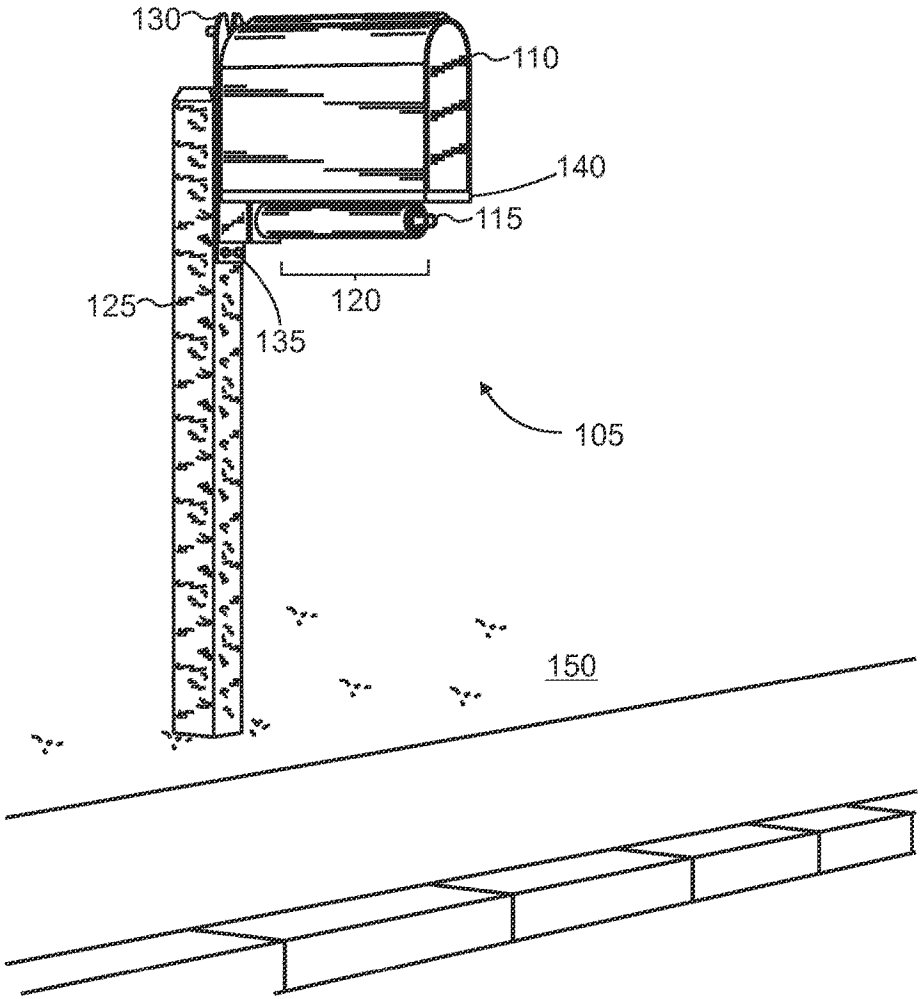
FIG. 1 shows an illustrative representation of an extendable mailbox in the retracted position.

FIG. 1 shows an illustrative environment in which an extendable mailbox 105 is in a retracted position. The mailbox includes a post 125, such as a wooden 4×4 post, which is inserted and secured to the ground or base 150. A bracket 130 is fastened to the post using, for example, threaded bolts 135. The extendable mailbox includes a telescoping rod set 120 having a handle 115 on an end thereof for extending and retracting the telescoping rods. The telescoping rod set 120 is secured to the bracket 130 on the post 125. The receptacle 110 is positioned on and attached to a receptacle bracket 140 which, in this implementation, is sized to fit an entire bottom surface of the receptacle. The receptacle bracket is attached to a front end of the telescoping rods to enable the mailbox to extend with the telescoping rod set.

Figure 2:
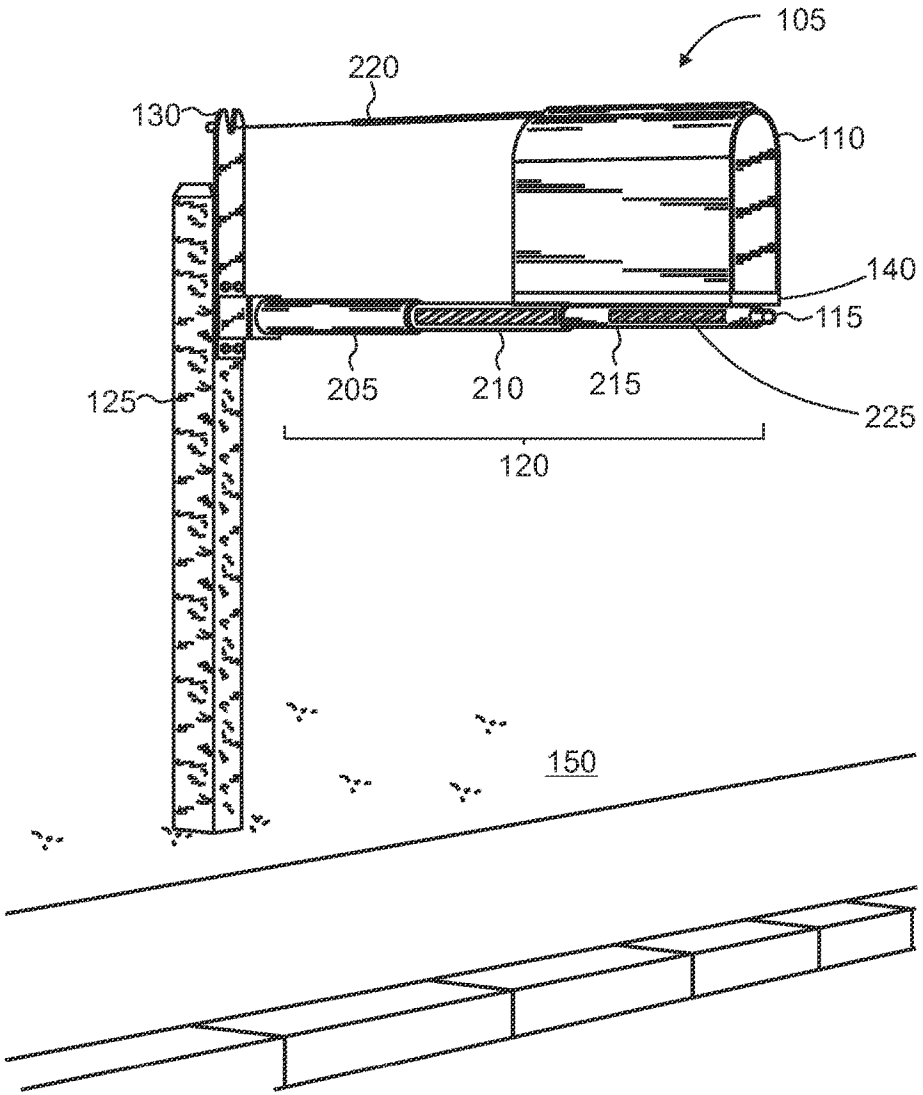
FIG. 2 shows an illustrative representation of the extendable mailbox in the extended position.

FIG. 2 shows an illustrative environment in which the extendable mailbox 105 is in an extended position. The telescoping rod set 120 includes an outer telescoping rod 205, a middle telescoping rod 210, and an inner telescoping rod 215. In this implementation, the middle and inner telescoping rods include reflective or bright surfaces 225 which make the extended mailbox observable to passerby including drivers, bicyclists, plows, etc.

The inner telescoping rod 215 is positioned inside of and extends from the middle telescoping rod 210. The middle telescoping rod 210 is positioned inside of and extends from the outer telescoping rod 205. Rear ends of the middle and inner telescoping rods may have flanges which engage with corresponding flanges on front ends of the outer and middle telescoping rods, respectively. Other telescoping designs to connect telescoping rods together are also possible, such as system in which corresponding threads are utilized to screw ends of telescoping rods together.

The extendable mailbox 105 includes a retractable rod 220 which is used to retract the extended mailbox and provide upper support for the mailbox. Additionally, the retractable rod can be used to push out the mailbox from the post-side in scenarios in which the front of the mailbox is obstructed with snow. In this regard, the retractable rod may be more rigid than flexible (e.g., string) so that it can adequately push out the mailbox. In some implementations, the retractable rod may be telescoping with a clutch or other rotational lock mechanism to lock the mailbox in place when pushed outward. The locking mechanism may be provide a clockwise twist to lock and counter-clockwise twist to unlock the retractable rod.

The top of the bracket 130 includes a slit 310 inside which the retractable rod 220 rests. The slit enables the rod to pivot when the mailbox is impacted by some outside force (e.g., a plow). In this implementation, the retractable rod is positioned at an upper portion of the mailbox, but in other implementations, the retractable rod may be positioned on a lower portion of the mailbox.

Figure 3:
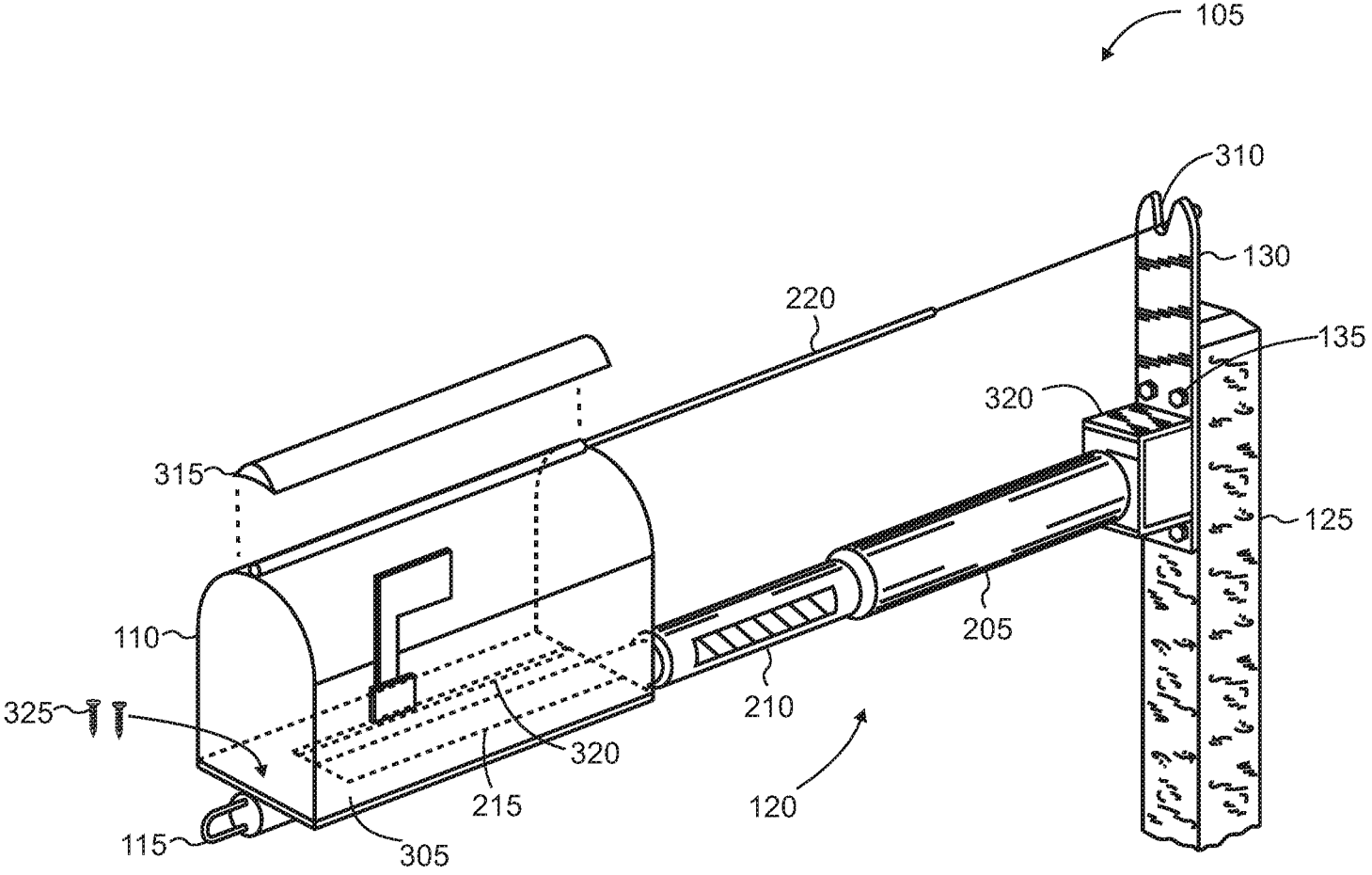
FIG. 3 shows an illustrative representation of the telescoping segments, receptacle bracket, and a cover of the receptacle of the extendable mailbox.

FIG. 3 shows an illustrative environment in which a cover 315 on the receptacle 110 is lifted to show the retractable rod 220 positioned on top thereof. The cover protects the retractable rod from being exposed to the weather, such as snow and rain. In typical implementations, the cover may removably attach to the top of the receptacle via a press-fit, tab and notch mechanism, screws, or adhesive.

The broken lines show the various components underneath the receptacle 110 which would typically be blocked from the vantage point in FIG. 3. As shown, the receptacle is positioned on and attached to a receptacle bracket 140 that is secured to the end of the inner retractable rod 215 with, for example, screws 305, adhesive, tabs and notches, or any combination thereof. The receptacle bracket includes tracks 320 which engage or secure to the outer retractable rod 205 so that the mailbox is secured in place when in the retracted position. Thus, for example, the inner space inside the inner receptacle bracket may correspond to a size and shape of the outer retractable rod.

The extendable mailbox 105 includes a sealed enclosure 320 which, as discussed in greater detail below, encases the pivot point for the mailbox to laterally pivot when impacted by some outside force, like a plow, car, etc. The sealed encasing is fully encased on all sides to prevent rain, snow, etc., from entering and causing rust on its components.

Figure 4:
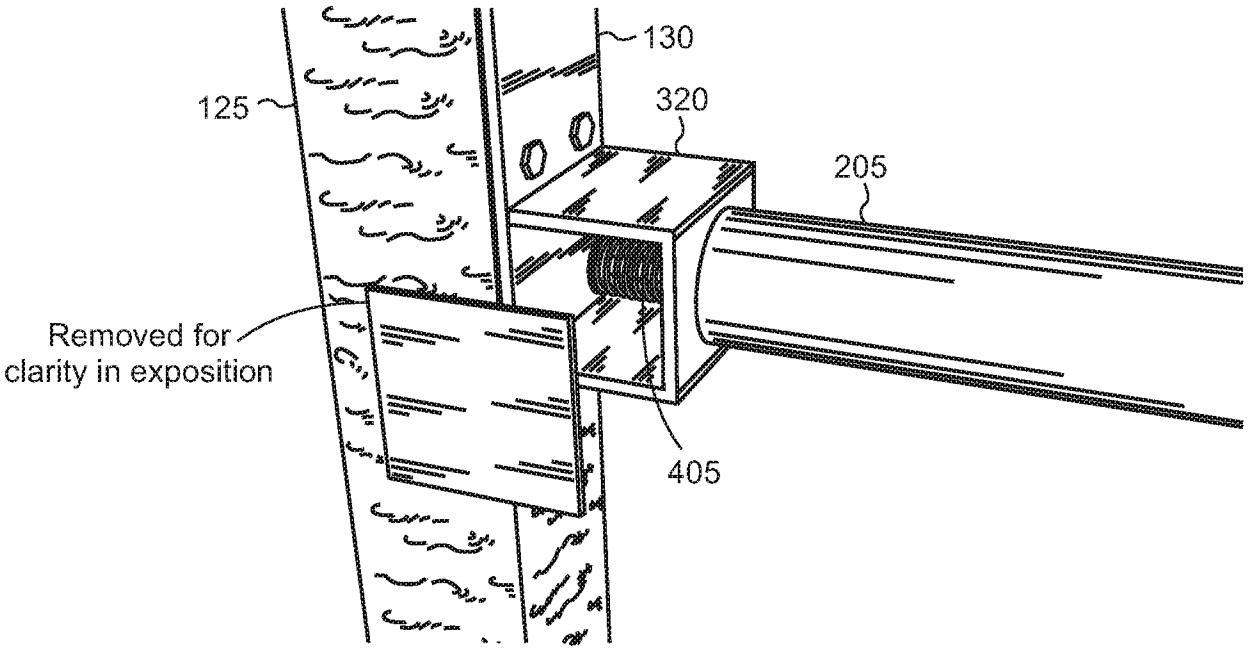
FIG. 4 shows an illustrative representation of an enclosure for the extendable mailbox.

FIG. 4 shows an environment in which a side of the enclosure 320 is removed to illustrate the inside components. The outer telescoping rod 205 extends from the enclosure 320. The enclosure includes a spring which creates break-away action when the mailbox is impacted. The break-away action facilitated by the spring causes a laterally pivoted mailbox to revert back to its original position in which it aligns parallel with the post 125.

Figure 5:
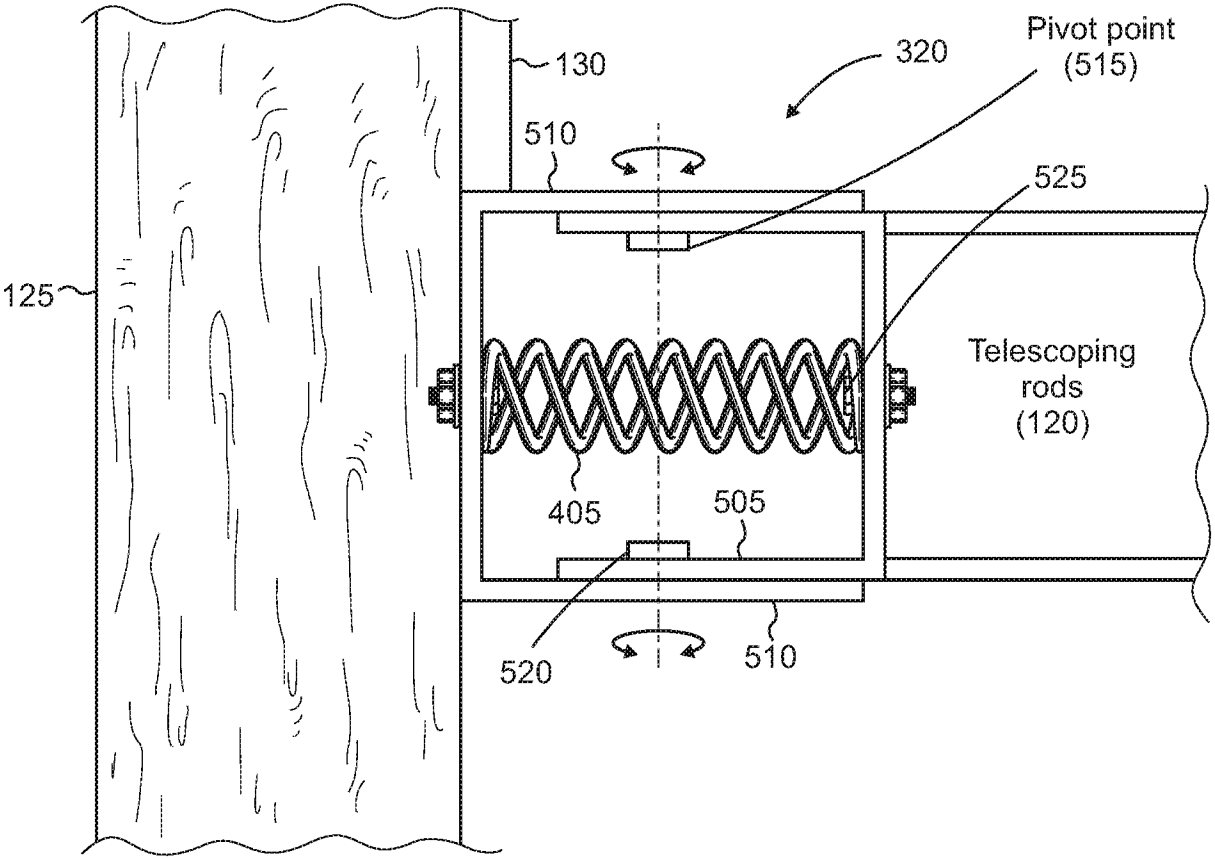
FIG. 5 shows an illustrative representation of the interior components of the enclosure for the extendable mailbox.

FIG. 5 shows an illustrative representation in which the internal components of the enclosure 320 are depicted. The enclosure is comprised of two opposing U-shaped boxes, a telescoping-side U-shaped box 505 and a post-side U-shaped box 510. The telescoping-side U-shaped box is positioned on an inside of the post-side (or outer) U-shaped box. The U-shaped boxes are connected to each other using bolts 520. Although not shown in FIG. 5, the sides of the enclosure may be sealed off, as shown in FIGS. 1-3, to protect the inner components from rusting.

The bolts 520 which connect the telescoping- and post-side U-shaped boxes 505 and 510 together create the pivot point 515 about which the extendable mailbox 105 laterally pivots left and right responsive to some impact from a plow, car, bicyclist, etc. A spring 405 is attached to opposing sides of the telescoping- and post-side U-shaped boxes which creates a sprung hinge that causes the break-away action. Specifically, the extended mailbox springs back to a position of alignment with the post 125 after some impact causes it to pivot. The spring may be attached to the opposing U-shaped boxes using some bolt or, in some implementations, the spring can be welded to the enclosure's sides (not shown).

Figure 6:
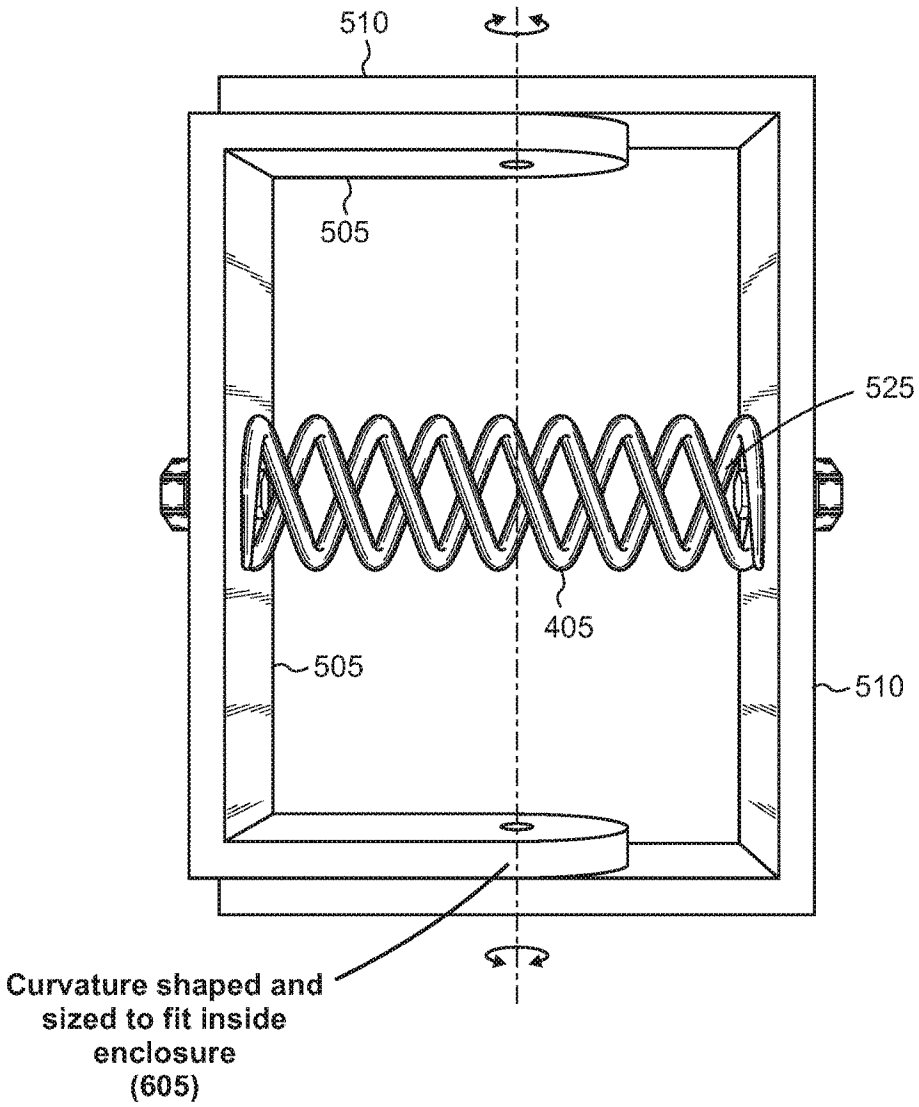
FIG. 6 shows an illustrative representation of the spring and curved structure of one of the enclosure's U-shaped boxes.

FIG. 6 shows an illustrative representation in which the telescoping-side U-shaped box 505 is shaped, sized, and curved to enable pivoting about the pivot point 515, as representatively illustrated by numeral 605. Since the enclosure 320 is sealed on all sides, the curvature of the telescoping-side U-shaped enclosure 505 enables the component to pivot without engaging with the sides of the enclosure (see FIGS. 1-4) and thereby interfering with the pivotal movement.

Figure 7:
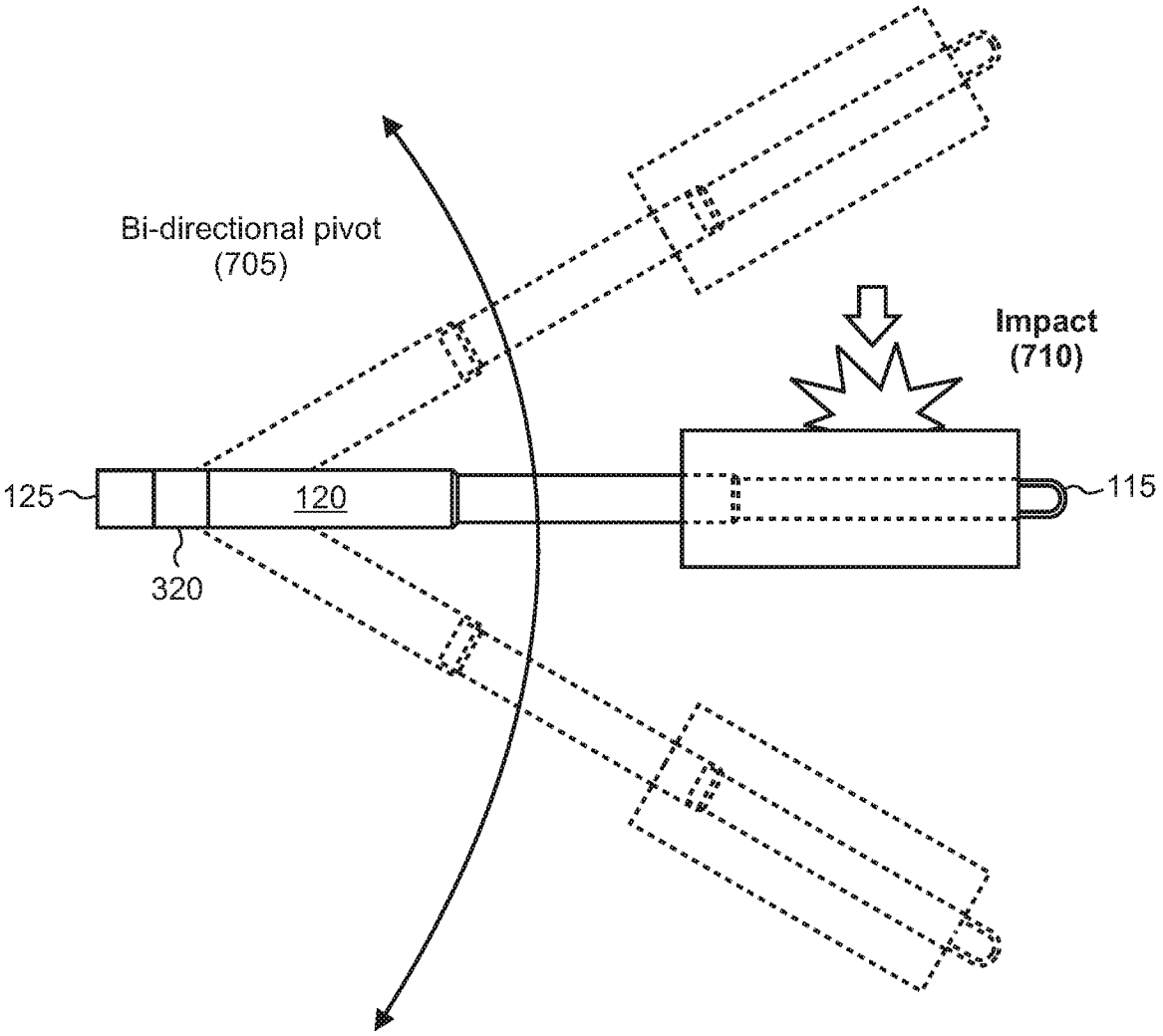
FIG. 7 shows an illustrative representation of the extendable mailbox's ability to bi-directionally pivot responsive to some impact or force.
Figure 8:
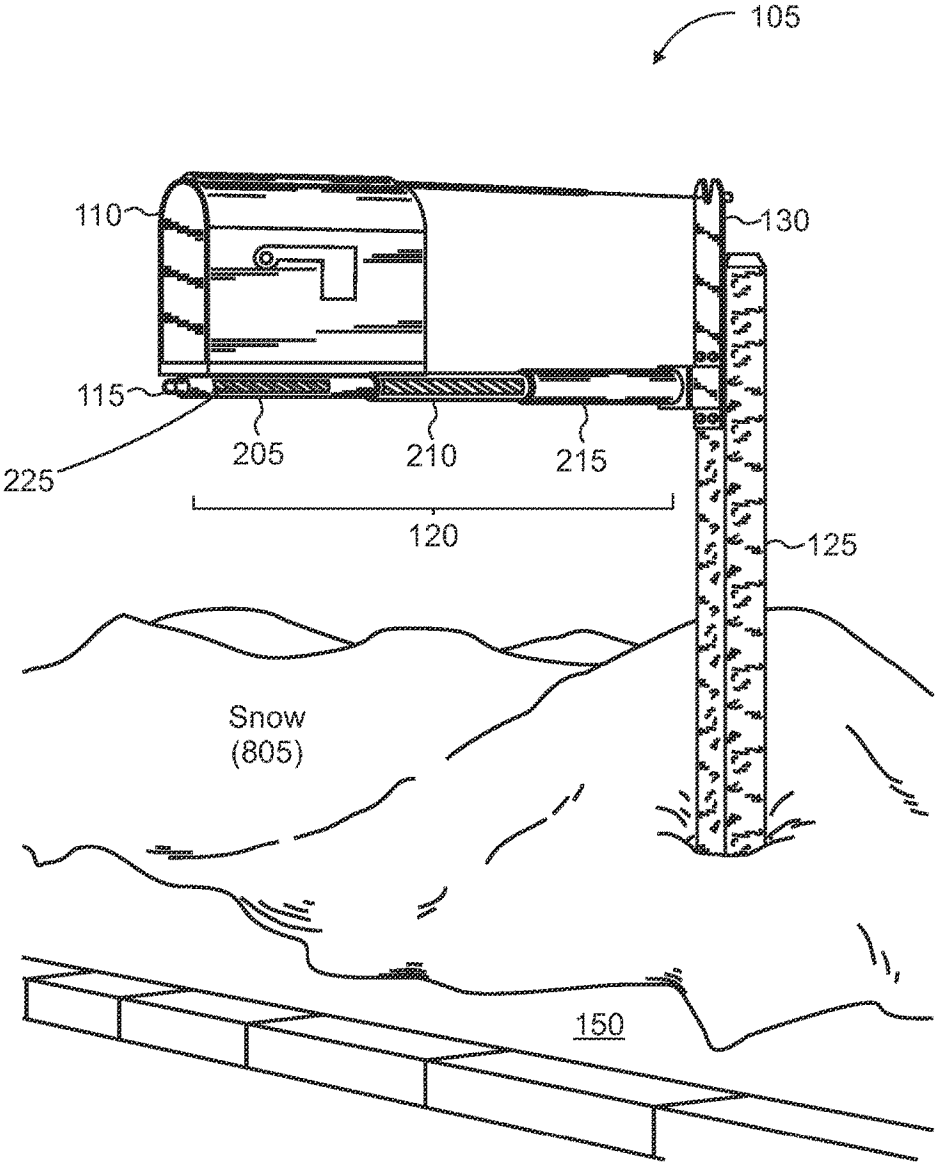
FIG. 8 shows an illustrative representation in which the mailbox is extended for easier accessibility in the snow.

FIG. 7 shows an illustrative representation in which the extendable mailbox 105 laterally pivots to the left and right responsive to some impact 710. The extendable mailbox and break-away action enables the extendable mailbox to bi-directionally pivot 705 about the enclosure 320 (FIGS. 5 and 6). The ability to bi-directionally pivot can protect the mailbox from damage due to some external vehicular force such as a plow, truck, vehicle, garbage truck, etc. The extendable mailbox moves in the direction of incoming impact and then springs back to its proper position of being aligned with the post using the sprung hinge. As a result of the configuration, mailboxes will not be destroyed by snow plows and other vehicles that drive too close to the sidewalks. Furthermore, homeowners can save time by shoveling less of a passageway through the snow 805 since the mailbox can extend into the street, as shown in FIG. 8. Thus, the extendable mailbox saves homeowner's shoveling time while also preventing or reducing the amount of damage caused by passerby plows.

Various exemplary embodiments are now disclosed. In one embodiment, an extendable mailbox is disclosed which comprises: a post which is secured to a base; a mounting bracket secured to the post; a enclosure attached to the bracket, wherein the enclosure includes a spring; a set of telescoping rods connected to the enclosure, and which extends outward from the enclosure; a receptacle bracket attached to one or more telescoping rods of the set of telescoping rods; and a receptacle secured to the receptacle bracket, wherein extension of the set of telescoping rods moves the receptacle outward from the post.

In an example, the post is vertically oriented from the base. In another example, the mounting bracket is secured to an upper portion of the post. In another example, the extendable mailbox further comprises a handle positioned on an end of the set of telescoping rods to enable a user to pull the receptacle outward. Another example further comprises a reflective material positioned on one or more of the receptacle rods in the set to provide greater visibility of the extendable mailbox. In another example, the enclosure is sealed to make its components waterproof. Another example further comprises a retractable rod to enable retraction of the receptacle and the set of telescoping rods. As another example, the retractable rod is connected to the mounting bracket, and wherein the mounting bracket includes a slit through which the retractable rod is positioned. As another example, the retractable rod is connected to a top portion of the receptacle, in which removable cover attaches to the top portion of the receptacle to cover the retractable rod and screw holes from outside elements. In another example, the enclosure includes two opposing U-shaped boxes connected together at a pivot point, wherein a post-side U-shaped box is attached to the post and a telescoping-side U-shaped box is attached to the set of telescoping rods. In another example, one end of the spring is attached to the post-side U-shaped box and an opposite end of the spring is attached to the telescoping-side U-shaped box. As another example, a bolt connects the two U-shaped boxes together, in which the pivot point is about the bolt. In another example, the telescoping-side U-shaped box has curved portions to enable swiveling inside the enclosure.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. An extendable mailbox, comprising:

a post;

a mounting bracket secured to the post;

an enclosure attached to the bracket, wherein the enclosure includes a spring;

a set of telescoping rods connected to the enclosure, and which extends outward from the enclosure;

a receptacle bracket attached to one or more telescoping rods of the set of telescoping rods; and a receptacle secured to the receptacle bracket, wherein extension of the set of telescoping rods moves the receptacle outward from the post.

2. The extendable mailbox of claim 1, wherein the post is vertically oriented from a base.

3. The extendable mailbox of claim 1, wherein the mounting bracket is secured to an upper portion of the post.

4. The extendable mailbox of claim 1, further comprising a handle positioned on an end of the set of telescoping rods to enable a user to pull the receptacle outward.

5. The extendable mailbox of claim 1, further comprising a reflective material positioned on one or more of the receptacle rods in the set to provide greater visibility of the extendable mailbox.

6. The extendable mailbox of claim 1, wherein the enclosure is sealed to make it waterproof.

7. The extendable mailbox of claim 1, further comprising a retractable rod to enable retraction of the receptacle and the set of telescoping rods.

8. The extendable mailbox of claim 7, wherein the retractable rod is connected to the mounting bracket, and wherein the mounting bracket includes a slit through which the retractable rod is positioned.

9. The extendable mailbox of claim 8, wherein the retractable rod is connected to a top portion of the receptacle, in which removable cover attaches to the top portion of the receptacle to cover the retractable rod and screw holes from outside elements.

10. The extendable mailbox of claim 1, wherein the enclosure includes two opposing U-shaped boxes connected together at a pivot point, wherein a post-side U-shaped box is attached to the post and a telescoping-side U-shaped box is attached to the set of telescoping rods.

11. The extendable mailbox of claim 10, wherein one end of the spring is attached to the post-side U-shaped box and an opposite end of the spring is attached to the telescoping-side U-shaped box.

12. The extendable mailbox of claim 11, wherein a bolt connects the two U-shaped boxes together, in which the pivot point is about the bolt.

13. The extendable mailbox of claim 12, wherein the telescoping-side U-shaped box has curved portions to enable swiveling inside the enclosure.

* * * * *